343-909 SR
8/18/81 OR 4,284,992

United States Patent [19]
Gans

[11] 4,284,992
[45] Aug. 18, 1981

[54] WIDE SCAN QUASI-OPTICAL FREQUENCY DIPLEXER

[75] Inventor: Michael J. Gans, Monmouth Beach, N.J.

[73] Assignee: Bell Telephone Laboratories, Incorporated, Murray Hill, N.J.

[21] Appl. No.: 106,492

[22] Filed: Dec. 26, 1979

[51] Int. Cl.[3] ..... H01Q 15/04; H01Q 15/06
[52] U.S. Cl. ..... 343/909; 333/248; 343/781 P
[58] Field of Search ..... 343/753, 754, 854, 909, 343/781 P; 333/248

[56] References Cited

U.S. PATENT DOCUMENTS

| | | | |
|---|---|---|---|
| 2,530,580 | 11/1950 | Lindenblad | 343/755 |
| 2,553,166 | 5/1951 | Bond | 343/909 |
| 2,636,125 | 4/1953 | Southworth | 343/755 |
| 2,663,848 | 12/1953 | Lewis | 343/755 |
| 2,870,444 | 1/1959 | Broussaud | 343/909 |
| 3,698,001 | 10/1972 | Koyama et al. | 343/909 |
| 4,079,382 | 3/1978 | Henry | 343/753 |

OTHER PUBLICATIONS

Dragone; New Grids for Improved Polarization Diplexing of Microwaves in Reflector Antennas, vol. AP-26, No. 3, May 1978, pp. 459–463.
Saleh et al.; A Quasi-Optical Polarization Independent Diplexer for Use in Millimeter-Wave Antennas, vol. AP-24, No. 6, Nov. 1976, pp. 780–785.
Koyama et al.; The Quasi-Optical Filters Used for the Domestic Satellite Communications Systems, Electronics and Communications in Japan, vol. 56-B, No. 3, pp. 74–81.

*Primary Examiner*—Eli Lieberman
*Attorney, Agent, or Firm*—Erwin W. Pfeifle

[57] ABSTRACT

The present invention relates to a quasi-optical frequency diplexer capable of operating over a wide angle of scan and separating microwave signals possessing proximate center frequencies. The present invention, which in one aspect may be employed with a phased array antenna arrangement functioning so as to separate the transmit and receive frequencies associated therewith, consists of an array of waveguide sections (22) where the input and output ports (30, 32) of the array are tilted with respect to the array's longitudinal axis. The angles of tilt and the dimensions of the waveguide sections may be adjusted so as to achieve frequency diplexing with a minimal amount of interference between the diplexed signals.

6 Claims, 5 Drawing Figures

WIDE SCAN QUASI-OPTICAL FREQUENCY DIPLEXER

BACKGROUND OF THE INVENTION

1. Technical Field

This invention relates to a wide scan quasioptical frequency diplexer, and more particularly, to using an array of waveguide sections as a diplexer where the input and output ports of the array are tilted at oblique angles with respect to its longitudinal axis, the tilted ports allowing the diplexer to operate over a wide angle of scan.

2. Description of the Prior Art

In order to achieve greater utilization of microwave antenna systems, frequency diplexing is needed to allow simultaneous transmission and reception of microwave signals. One method of frequency diplexing is to incorporate a waveguide diplexer with the antenna feed. Alternatively, the incoming beam may be intercepted by a frequency sensitive device before it enters the feed, this method being referred to as quasi-optical diplexing.

A number of designs have been suggested in the past for quasi-optical diplexing at microwave frequencies. One such design technique is discussed in the article "A Quasi-Optical Polarization-Independent Diplexer for Use in the Beam Feed System of Millimeter-Wave Antennas" by A. A. M. Saleh et al in *IEEE Transactions on Antennas and Propagation,* Vol. AP-24, No. 6, November 1976 at pp. 780–785. This paper presents a diplexer consisting of a parallel-plane Fabry-Perot resonator having two metallic meshes with rectangular cells. The ratio between the width and length of the rectangles is chosen to yield polarization-independent operation at the desired angle of incidence. Such a diplexer, however, operates satisfactorily only over a narrow range of incidence angles, due to the walk-off effects associated with metallic mesh diplexers.

An alternative metallic mesh diplexer arrangement is disclosed in U.S. Pat. No. 2,636,125 issued to G. C. Southworth on Apr. 21, 1953. Waveguide structures are used to filter or purify a beam of electromagnetic waves for the purpose of restricting the beam to a desired frequency band. Moreover, within the transmission frequency band of the guide, the phase velocity for a wave of a given frequency is dependent upon the transverse dimension of the guide and increases as that transverse dimension decreases. Therefore, it is possible, by using a parallel assemblage of such guides, to build a structure through which the propagation velocity of a given frequency wave may be determined by the design of the structure.

An antenna system using the Southworth diplexer discussed hereinabove is disclosed in U.S. Pat. No. 2,870,444 issued to G. Broussaud on Jan. 20, 1959. This invention relates to an antenna capable of radiating or receiving simultaneously, two waves of different frequencies, with high efficiency and without any disturbing effect from one wave on the other. The Broussaud antenna comprises essentially a combination of two sources of radiation, positioned respectively on either side of a Southworth diplexer, serving respectively as a lens and a mirror for the two sources. In order for this structure to be capable of both transmitting and receiving, however, the antenna passbands must be separated by at least one octave.

In an alternative approach, multilayer stacks have been considered as a method of quasi-optical diplexing.

One such design is disclosed in U.S. Pat. No. 3,698,001 issued to M. Koyama et al on Oct. 10, 1972. The koyama et al diplexer is designed to separate in reception the composed beams of high and low frequency groups, and conversely, in transmission to compose the separate beams of such high and low frequency groups. The diplexer comprises a plurality of laminated dielectric elements each having a thickness equal to one-fourth the wavelength of the central frequency of the high frequency group, and possessing as a whole at least two dielectric constants. However, the Koyama et al diplexer is not capable of separately detecting signal components having a broad frequency range and relatively close center frequencies.

The problem remaining in the prior art then, is to achieve quasi-optical diplexing over a wide angle of scan, without introducing the walk-off effects associated with metallic mesh diplexers.

SUMMARY OF THE INVENTION

The problem remaining in the prior art has been solved in accordance with the present invention, which relates to a wide scan quasi-optical frequency diplexer, and more particularly, to using an array of waveguide sections as a diplexer, where the input and output ports of the array are tilted at oblique angles with respect to its longitudinal axis, the tilted ports allowing the diplexer to operate over a wide angle of scan.

It is an aspect of the present invention to provide a wide scan frequency diplexer capable of effective operation over the wide angle of scan that future satellite systems may employ. The wide scan frequency diplexer comprises an array of waveguide sections and is disposed in the path of a multifrequency beam in such a manner so that the waveguide sections of the diplexer are tilted with respect to the beam path-diplexer interface. The angles of tilt of the input and output ports thereby allows the multifrequency beam to enter the diplexer over a wider range of angles than possible with prior art diplexers and still be effectively separated with a minimal amount of interference between the separated beams.

Other and further aspects of the present invention will become apparent during the course of the following description and by reference to the accompanying drawings.

BRIEF DESCRIPTION OF THE DRAWINGS

Referring now to the drawings, in which like numerals represent like parts in several views.

DETAILED DESCRIPTION

A Cassegrain phased array antenna arrangement is used in the description that follows and the accompanying drawings for illustrative purposes only. It will be understood that such description is exemplary only and is for purposes of exposition and not for purposes of limitation since the present invention may be employed whenever wide scan frequency diplexing is required.

Figure 1:
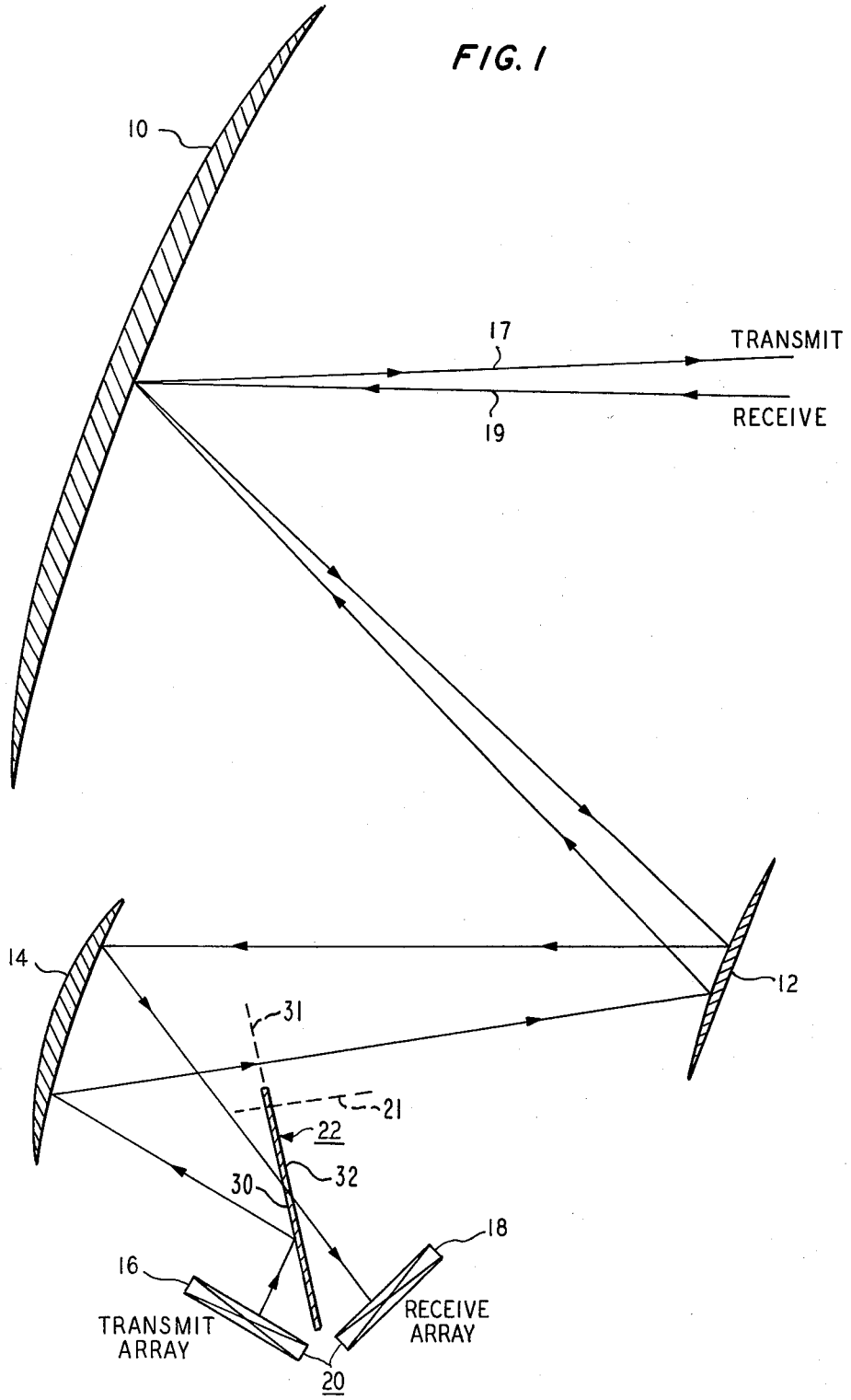
FIG. 1 is a partial side cross-sectional view of an exemplary Cassegrain phased array antenna arrangement in accordance with the present invention.

In FIG. 1, an exemplary Cassegrain phased array antenna arrangement, comprising a quasi-optical frequency diplexer in accordance with the present invention, is shown. A main reflector 10, a subreflector 12 and an imaging reflector 14 are arranged so that an image appearing at feed arrangement 20 is enlarged several times before arriving at main reflector 10. In this specific antenna arrangement, feed arrangement 20 comprises two arrays, a transmit array 16 and a receive array 18, capable of transmitting and receiving, respectively, two distinct wideband signals 17 and 19 having proximate center frequencies.

A frequency diplexer 22 formed in accordance with the present invention comprises an array of waveguide sections disposed between transmit array 16 and receive array 18 in such a manner so that the waveguide sections are tilted at predetermined angles with respect to the diplexer-free space interface 31. The angles are determined to allow diplexer 22 to simultaneously operate with both wideband signals 17 and 19 so that signal 19 passes through diplexer 22 with a minimal amount of reflection while signal 17 is reflected and redirected by diplexer 22 with a minimal amount of transmission.

Figure 2:
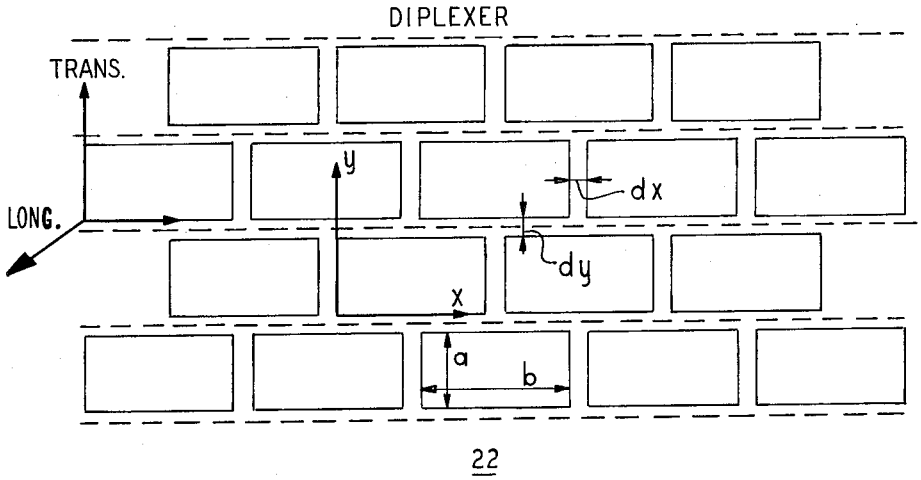
FIG. 2 is a front view of an exemplary quasi-optical diplexer in accordance with the present invention.

A front view of an exemplary frequency diplexer 22 is shown in FIG. 2, where diplexer 22 comprises an array of waveguide sections, each section of equal width b and equal height a, with equal spacings dy and dx in the y- and x-directions, respectively, between each section. The rows of the array are parallel, but displaced in the x-direction as shown, to form a "brick structure", where this structure reduces the grating lobe problem introduced by phased array implementation.

In determining the dimensions involved, it is well-known from waveguide transmission theory that for the electric field perpendicular to the x-direction, the dimension b of an arbitrary waveguide section of diplexer 22 is associated with the center frequency of transmitting signal 17 discussed hereinabove in association with FIG. 1. Viewing the diplexer as a filter, this center frequency can be related to the cutoff frequency, with transmitting signal 17 being contained in the stopband and receiving signal 19, discussed hereinabove in association with FIG. 1, being contained in the passband. The dimension a of an arbitrary waveguide section of diplexer 22 is related in a like manner to the cutoff frequency described hereinabove in association with the dimension b, where in this case the electric field is oriented perpendicular to the y-direction to determine the dimension a. The dimension a is also subject to practical limits, where too large a value of a induces grating lobes while as the dimension a approaches too small a value, poor transmission results. The results of dx and dy are chosen to be as thin as possible without unduly complicating the fabrication of the diplexer.

Figure 3:
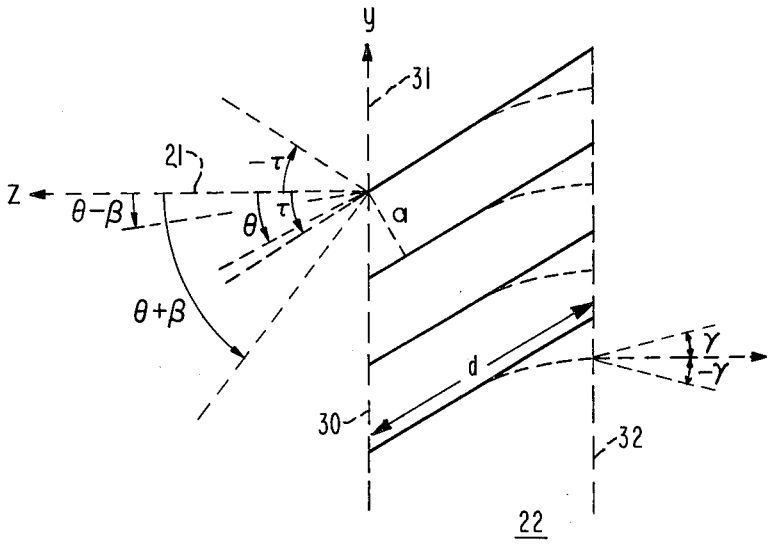
FIG. 3 is a side view of an exemplary quasi-optical diplexer, indicating the tilt of the input and output ports with respect to the free space-diplexer interface, where the solid curve represents a diplexer comprising equal angles of tilt at the input and output ports and the dashed curve represents a diplexer comprising unequal angles of tilt at the input and output ports, in accordance with the present invention.

FIG. 3 contains a cut-away side view of an exemplary quasi-optical frequency diplexer formed in accordance with the present invention. Shown in this perspective, the length d and the angles of tilt $\tau$ and $\gamma$ are evident. The length d must be of such dimension so that little of the energy in the stopband described hereinabove in association with FIG. 2 is coupled to the transmission mode, but not of such length that the Q of diplexer 22 becomes large, thereby reducing the bandwidth. Also, length d must be chosen such that multiple reflected waves in the passband add constructively. All of these conditions are met when diplexer 22 is tuned to a low order resonance, the length d corresponding to about a half-wave length in the passband. The angle of tilt $\tau$ is chosen according to the angle of the incident field arriving at input port 30 of diplexer 22 where $\tau$ is measured with respect to longitudinal axis 21, where axis 21 is defined as the perpendicular to diplexer-free space interface 31. If the entire sector of scan is denoted $\theta \pm \beta$, the angle tilt $\tau$ is approximately equal to the center angle, $\theta$, of incident waves, thereby allowing transmission with a minimum of deflection. By the reciprocity associated with electromagnetic field theory, signals arriving at the angle $-\tau$ will have like transmission properties with respect to signals arriving at $+\tau$. Thus diplexer 22 performs in a like manner to a double pole filter; i.e., wideband transmission versus scan angle results between $-\tau$ and $+\tau$. Therefore, to ensure adequate transmission over angles between $\theta-\beta$ and $\theta+\beta$, $\tau$ should be chosen to be somewhat larger than $\theta$ so that most of the field of scan will lie between the filter peaks of $-\tau$ and $+\tau$. The angle of tilt at output port 32 may also be the angle $\tau$, thereby allowing straight waveguide sections to be employed in association with the present invention. An alternative arrangement is shown by the dashed lines in FIG. 3, where bent waveguide sections are employed, thereby changing the angle of tilt at the output port, in this example to achieve the smaller angle of tilt $\gamma$. By decreasing, or alternatively, increasing the angle, diplexer 22 becomes a four pole filter comprising peaks of $-\gamma$ and $+\gamma$ disposed between, or alternatively, outside those of $-\tau$ and $+\tau$, thereby achieving a flatter frequency response over the desired field of scan $\theta \pm \beta$.

Figure 4:
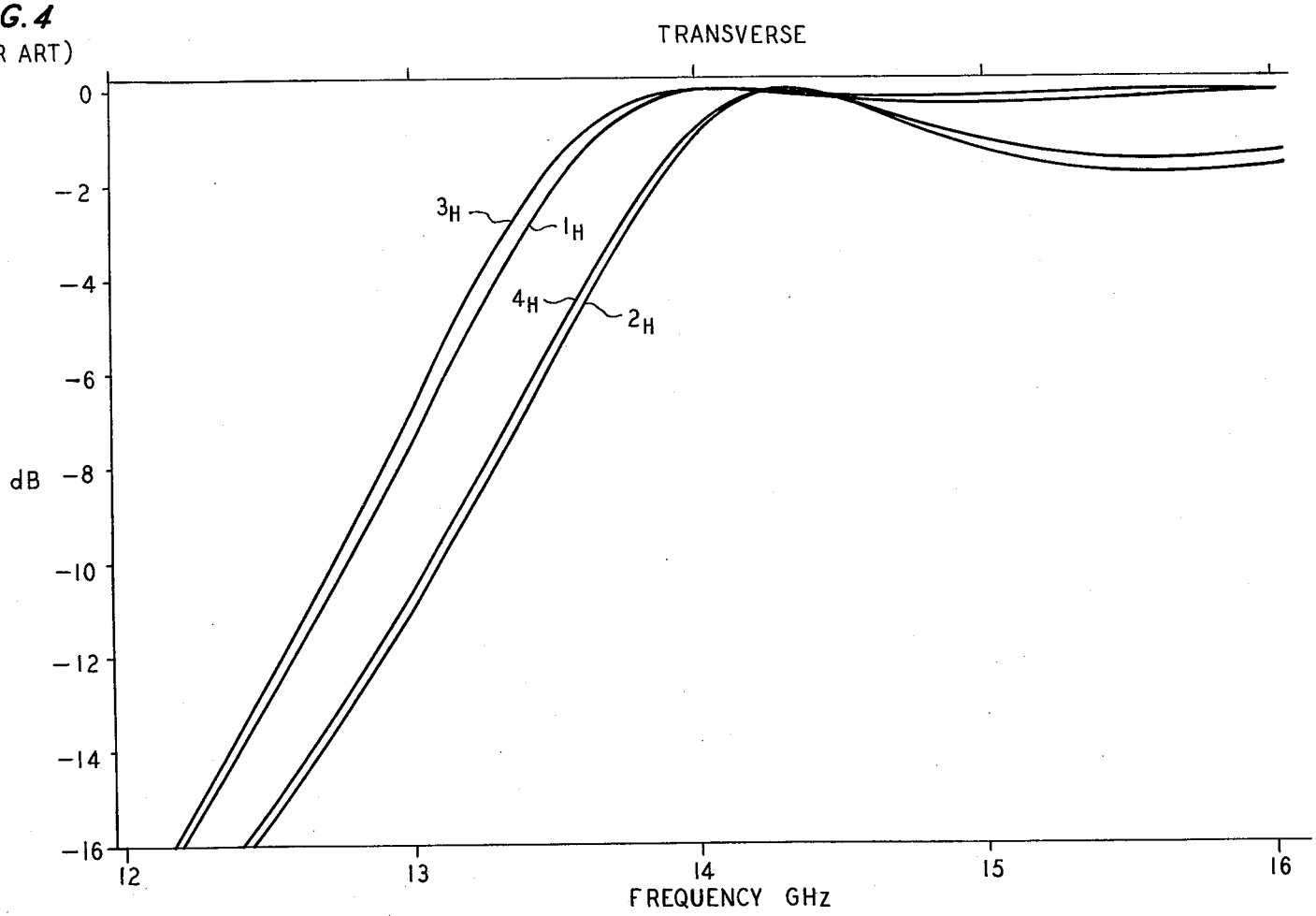
FIG. 4 (PRIOR ART)
FIG. 4 illustrates the frequency responses for various prior art quasi-optical frequency diplexers obtained for four worst-case angles of scan, each separate curve illustrating the response for a different worst-case angle of scan.

FIG. 4 illustrates the frequency responses for various prior art diplexer arrangements. For this specific illustration, the diplexers were operated over the frequency range of 12–16 GHz, with a cutoff frequency of 12.93 GHz, thereby determining the dimension b for the waveguide sections, from well-known waveguide transmission theory, to be 1.16 cm. The subsequent values of the rest of the parameters were chosen to optimize performance, with the dimension a set at 0.22 cm, dx and dy at 0.01 cm, and 1 at 2.40 cm. The four scans used in this specific illustration and hereinafter in association with FIG. 5 were determined to be the worst-case values that may be encountered by the diplexer, these worst-case values being discussed in greater detail hereinafter.

It is to be noted that these specific values described hereinabive are for the purpose of illustration and not limitation, since any such suitable parameter values falling within the bounds discussed in association with FIG. 2 and 3 may be employed and still fall within the spirit and scope of the present invention.

Turning now to FIG. 4, the prior art curves, denoted $1_H$, $2_H$, $3_H$ and $4_H$, where the subscript H refers to the horizontal orientation of prior art diplexers, each pertain to a different worst-case angle of scan. Each worst-case angle of scan is defined in terms of the direction cosines of the incident field and is denoted by an ordered pair (x,y) with respect to the x, y and z axes as shown in FIGS. 2 and 3, where the direction cosines are normalized to retain unity magnitude. Specifically, the ordered pair (0,0.61) is associated with curve $1_H$, the ordered pair (0,0.89) is associated with curve $2_H$, the ordered pair (0.31,0.58) is associated with curve $3_H$, and the ordered pair (0.19,0.87) is associated with curve $4_H$. As can be seen, all four worst-case situations adequately pass the desired 14 GHz transmission frequency while stopping frequencies below the cutoff value of 12.93 GHz. However, for the worst-case angles associated with curves $2_H$ and $4_H$, the response in the passband is not as flat as is needed to insure broadband performance with negligible degradation.

Figure 5:
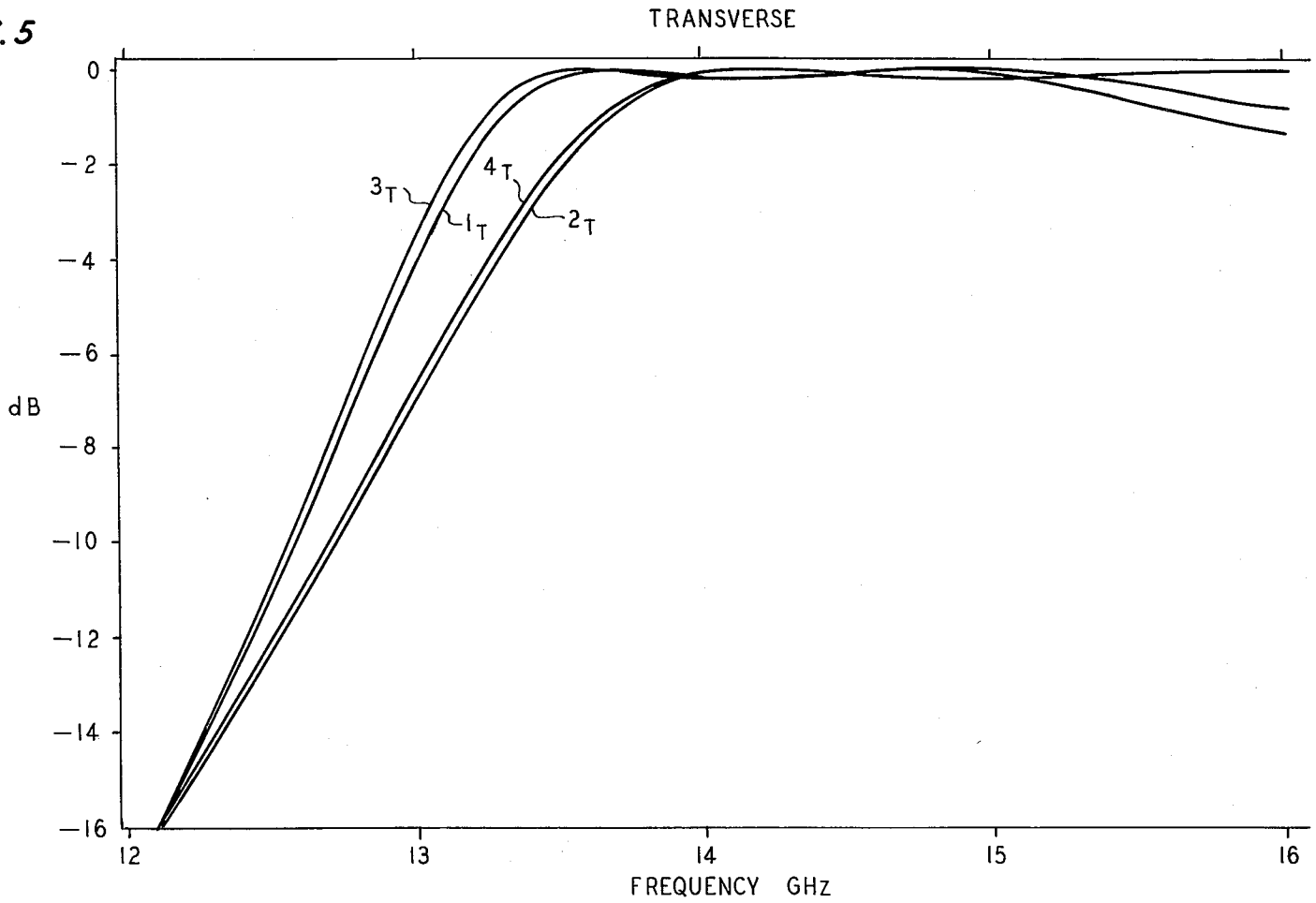
FIG. 5 illustrates the frequency responses for various quasi-optical frequency diplexers formed in accordance with the present invention employing the same worst-case angles of scan as the curves illustrated in FIG. 4.

FIG. 5 illustrates the frequency responses for various curves formed in accordance with the present invention, where the angle of tilt $\tau=54.43$ degrees for this specific example. The curves $1_T$, $2_T$, $3_T$ and $4_T$, where the subscript T refers to the tilt of the diplexer, are directly related to the prior art curves discussed hereinabove in association with FIG. 4, where curves $1_H$ and $1_T$ were determined for the same angle of scan; $2_H$ and $2_T$, $3_H$ and $3_T$, and $4_H$ and $4_T$ being correlated in a like manner. As can be seen from FIG. 5, all four worst-case situations still provide adequate cutoff between the passband and stopband. Compared to the prior art curves $2_H$ and $4_H$ of FIG. 4, the curves $2_T$ and $4_T$ of FIG. 5 are significantly flatter in the passband, indicating the improvement in performance of the present invention with respect to prior art quasi-optical frequency diplexers.

It is to be understood that the above-described embodiments are simply illustrative of the principles of the present invention. Various other modifications and changes may be made by those skilled in the art which will embody the principles of the invention and fall within the spirit and scope thereof.

I claim:

1. A quasi-optical frequency diplexer comprising:

an array of a plurality of stacked waveguide sections (22) including a longitudinal axis (21) and a diplexer-free space interface (31) associated in a mutually perpendicular relationship, each waveguide section comprising a first and a second entrance port at each end thereof, and comprising dimensions which permit the passage of predetermined frequency bands characterized in that the first and the second entrance ports of each waveguide section of the plurality of waveguide sections are respectively aligned and parallel with one another and relatively displaced such that each waveguide section is tilted at a predetermined oblique angle ($\tau$) to the longitudinal axis of the array.

2. A quasi-optical frequency diplexer in accordance with claim 1 characterized in that the first and second entrance ports of each waveguide section of the plurality of waveguide sections are respectively aligned and parallel with one another and relatively displaced such that each end of each waveguide section is tilted at a same predetermined oblique angle to the longitudinal axis of the array.

3. A quasi-optical frequency diplexer in accordance with claim 1 characterized in that the first and second entrance ports of each waveguide section of the plurality of waveguide sections are respectively aligned and parallel with one another and relatively displaced such that each end of each waveguide section is tilted at a different predetermined oblique angle to the longitudinal axis of the array.

4. A quasi-optical frequency diplexer in accordance with claim 3 characterized in that each waveguide section of the plurality of stacked waveguide sections being of the same dimension in the longitudinal direction.

5. A quasi-optical frequency diplexer in accordance with claims 1, 2 or 3 characterized in that each row of the array of a plurality of stacked waveguide sections in parallel to each other along the array longitudinal axis and displaced a predetermined amount from an array transverse axis.

6. A quasi-optical frequency diplexer in accordance with claim 5 characterized in that each row of the array of a plurality of stacked waveguide sections is displaced from an array longitudinal axis in such a manner so that alternate columns of said arrays are aligned.

* * * * *

UNITED STATES PATENT AND TRADEMARK OFFICE

CERTIFICATE OF CORRECTION

PATENT NO. : 4,284,992

DATED : August 18, 1981

INVENTOR(S) : Michael J. Gans

It is certified that error appears in the above-identified patent and that said Letters Patent are hereby corrected as shown below:

Column 3, line 68, "results" should read --values--.
Column 4, line 64, "hereinabive" should read --hereinabove--.
Column 6, line 40, "in" should read --is--.

Signed and Sealed this

*Twenty-seventh* Day of *October 1981*

[SEAL]

*Attest:*

GERALD J. MOSSINGHOFF

*Attesting Officer*

*Commissioner of Patents and Trademarks*